United States Patent [19]

Terazaki

[11] Patent Number: 4,745,322

[45] Date of Patent: May 17, 1988

[54] DISPLAY UNIT HAVING EQUALLY SPACED DISPLAY ELEMENTS

[75] Inventor: Nobuo Terazaki, Nagasaki, Japan

[73] Assignee: Mitsubishi Denki Kabushiki Kaisha, Tokyo, Japan

[21] Appl. No.: 845,312

[22] Filed: Mar. 28, 1986

[30] Foreign Application Priority Data

Mar. 29, 1985 [JP] Japan ..... 60-66032

[51] Int. Cl.[4] ..... H01J 1/92; H01J 19/38; H01J 19/46; H01J 33/26

[52] U.S. Cl. ..... 313/1; 313/491; 313/497; 313/500

[58] Field of Search ..... 313/1, 3, 5, 500, 505, 313/583, 491, 495, 497, 422; 340/825.81, 825.82

[56] References Cited

U.S. PATENT DOCUMENTS 4,394,600 7/1983 Flannagan ..... 313/500
4,471,263 9/1984 Harvey ..... 313/583

*Primary Examiner*—David K. Moore
*Assistant Examiner*—K. Wieder
*Attorney, Agent, or Firm*—Sughrue, Mion, Zinn, Macpeak, and Seas

[57] ABSTRACT

A large-size display unit in which dark lines between individual display elements of which the overall unit is composed are eliminated and connections to the display elements are simplified. The inventive display unit includes a plurality of display element boards arranged in a matrix, each board having a plurality of the display elements mounted thereon. Each display element board has end portions bent backwardly in the vertical and horizontal directions of the board. Signal connectors are mounted on the backwardly bent end portions.

6 Claims, 3 Drawing Sheets

AA'

BB'

DISPLAY UNIT HAVING EQUALLY SPACED DISPLAY ELEMENTS

BACKGROUND OF THE INVENTION

The present invention relates to a display unit for displaying an image or information outputted by a computer.

FIG. 1 shows a front view of a part of a display device in which a large number of display units 3 are disposed. As shown in FIG. 1, display elements 1 are disposed in a matrix on a display element board 2. Each display unit 3 includes the display elements 1 and the display element board 2 on which the display elements 1 are disposed. Signal connectors 4, 5, 14, 15, 24, 25, 50, 60, 70 and 80 are mounted on the display element board 2 outside the area of the display elements 1. Matrix signals for driving the display elements 1 are applied in the vertical and the horizontal directions of the display unit 3 through these connectors. Connections are made as needed between the signal connectors. In the example shown in FIG. 1, the signal connectors 14 and 24 are connected to each other and the signal connectors 15 and 25 are connected to each other in the vertical direction, and the signal connectors 60 and 70 are connected to each other in the horizontal direction. Other portions are also likewise connected to each other sequentially.

FIG. 2 shows a front view of a conventional display device in which a plurality of display units 3 are disposed on a screen 100. When the screen 100 having the display units 3 is to be driven, matrix signals in the vertical and the horizontal directions of the screen 100 are applied to display elements 1 through signal connectors 4, 5, 14, 15, 24, 25, 50, 60, 70 and 80 so as to display information on the screen 100.

Since the signal connectors of the conventional display device are disposed as bars outside the display element board 2, signal plug connecting portions 3*a* must be provided on the peripheral part of the display unit 3. Since the display elements 1 cannot be mounted at the locations of the signal plug connecting portions 3*a*, the signal connectors and the signal plug connecting portions 3*a* unavoidably appear as black lines when the screen 100 is seen from a distance. Moreover, since the connection of the display unit 3 is complicated, the assembly and maintenance of the unit are difficult, and the reliablility of the display unit is less than desired.

SUMMARY OF THE INVENTION

The present invention was made in order to solve the above-mentioned problems.

It is an object of the present invention to provide a display unit in which the joints of an entire screen are made inconspicuous, whose assembly and maintenance are facilitated, and whose reliablility is enhanced.

In the display unit provided according to the present invention, the end portions of a display element board on which display elements are mounted are bent backwards and signal connectors are disposed on the backwardly bent and portions of the display element board.

Since the end portions of the display element board on which the display elements are mounted in the display unit provided according to the present invention are bent in this manner, the distances between the display elements can be made equal to each other. As a result, a large-size screen without conspicuous joints can be constructed.

DESCRIPTION OF THE PREFERRED EMBODIMENTS

Figure 1:
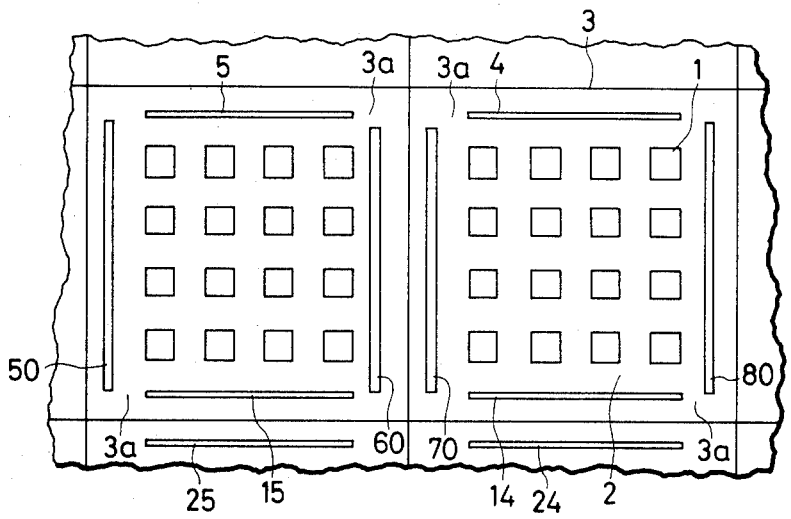
FIG. 1 PRIOR ART
FIG. 1 shows a front view of a part of a conventional display device.

Preferred embodiments of the present invention will hereinafter be described referring to the drawings.

Figure 2:
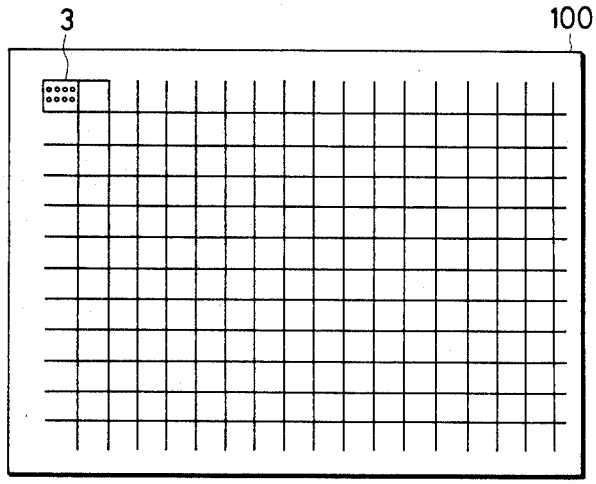
FIG. 2 PRIOR ART
FIG. 2 shows a front view of a conventional display device.
Figure 3:
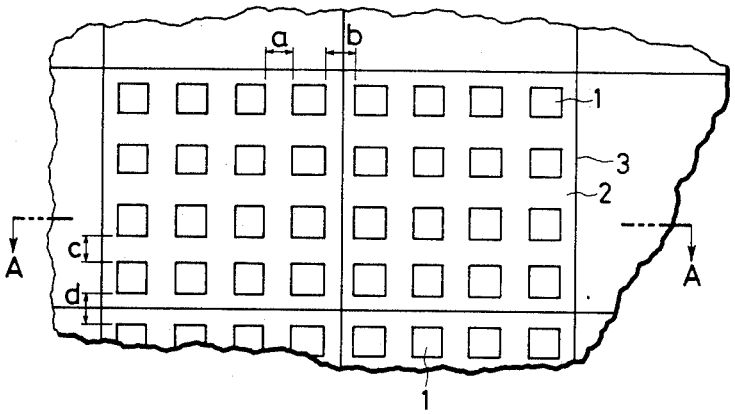
FIG. 3 shows a front view of a part of a display device composed of a plurality of display units constructed according to the present invention.
Figure 4:
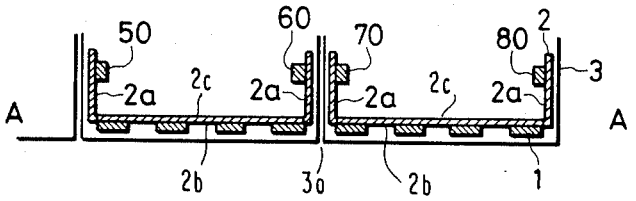
FIG. 4 shows a sectional view taken view along a line A—A in FIG. 1.
Figure 5:
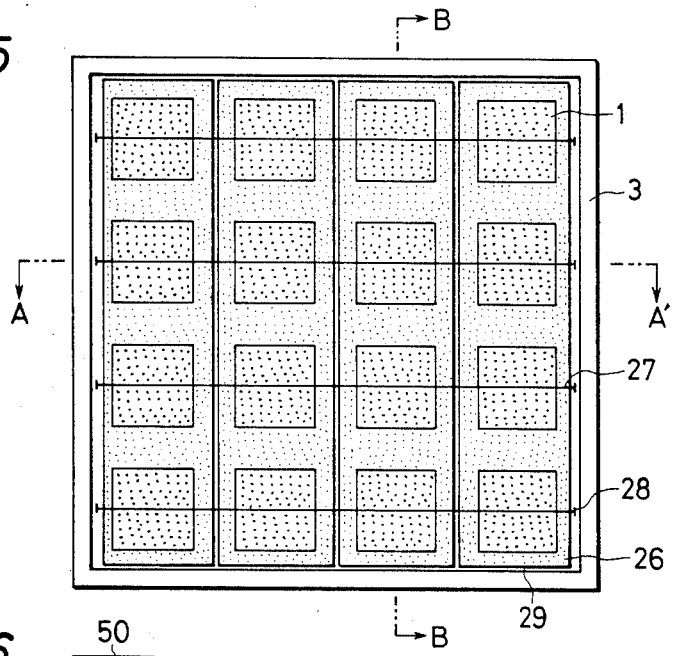
FIG. 5 shows a front view of a display unit of a second embodiment of the present invention.

FIG. 3, in which identical or equivalent portions are shown by the same symbols in FIGS. 1 and 2, shows a display element board 2 which holds display elements 1 and on which circuits (not shown) for driving the display elements 1 are provided. The horizontal end portions (right and left end portions) and vertical end portions (upper and lower end portions) of the display element board 2 are bent backwards from the vicinities of the outermost display elements 1. FIG. 4 shows the backwardly bent state of the horizontal end portions of the display element board 2, which are bent backwards at substantially a right angle from the vicinities of the outermost display elements 1. As shown in FIG. 4, a display unit 3 is bent backwards as a whole corresponding to the bending of the end portions of the display element board 2. Shown at 50, 60, 70 and 80 in FIG. 4 are signal connectors attached to the backwardly bent end portions 2*a* of the display element board 2. Penetration type connectors, male and female combination type connectors, or the like can be used in attaching the signal connectors to the backwardly bent end portions of the display element board 2.

In this embodiment, not only the horizontal end portions (right and left end portions) of the display element board 2, but also the vertical end portions (upper and lower end portions) of the board 2 are bent backwards. Similar signal connectors are attached to the backwardly bent vertical end portions of the board 2 as well.

The operation of the display unit of this embodiment will now be described.

Information is displayed on a screen 100 in the same way as a conventional display device. Since the horizontal and the vertical end portions of the display element board 2 are bent backwards according to the present invention, the distances between the display elements 1 can be made equal to each other so that a large-size screen without conspicuous joints can be constructed. As for the coupled state of the display units 3 in the horizontal direction, the distance a between the display elements 1 of each display unit 3 and that b between the display elements of the adjacent display units 3 are made substantially equal to each other, as shown in FIG. 3. As for the coupled state of the display units 3 in the vertical direction, the distance c between the display elements 1 of each display unit 3 and that d between the display elements 1 of the adjacent display units 3 are also made substantially equal to each other. As a result, the large-size screen without conspicuous joints can be constructed.

Since the signal connectors 50, 60, 70 and 80, which are attached to the backwardly bent and portions 2*a* of the display element board 2, are penetration types, male and female combination types, or the like, intermediate connecting cables are not needed.

Since the display units 3 can be simultaneously secured to each other, a screen of high dimensional accuracy can be easily constructed.

Although the end portions of the display element board are almost squarely bent backwards in the abovedescribed embodiment, the angle of the backward bending is not limited to about 90°, but may be arbitrarily determined as far as the above-described operation is attained.

According to the present invention, the end portions of the display element board on which the display elements are mounted are bent backwards and the signal connectors are disposed on the backwardly bent end portions, as described above. As a result, the distances between the display elements can be made equal to each other so that a large-size screen without conspicuous joints can be easily constructed. In addition, a cable for making connections between the display units is not needed, and hence the assembly and maintenance or the display units can be efficiently carried out and the reliability of the display units is enhanced.

FIGS. 5, 6, 7 and 8 show another embodiment of the present invention, namely, in the form of a fluorescent display tube.

Figure 7:
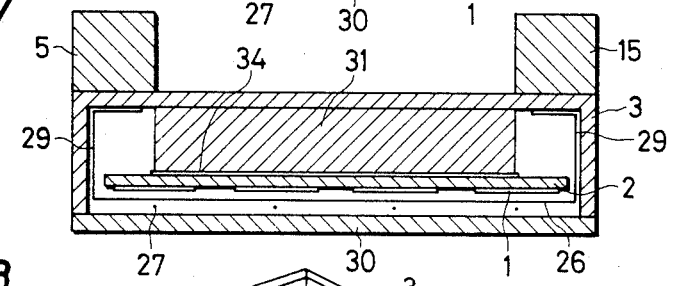
FIG. 7 shows a sectional view taken along a line B—B′ in FIG. 6.
Figure 8:
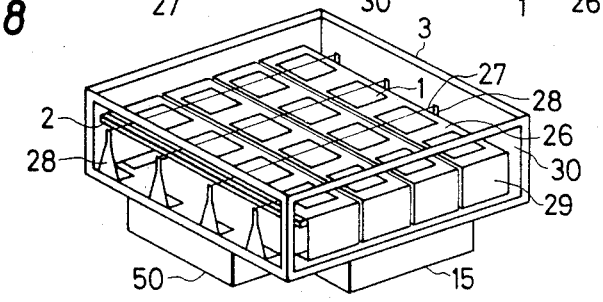
FIG. 8 shows a perspective view of the display unit 3.

Shown at 27 in FIG. 7 is a filament which is heated by a filament drive signal applied thereto from the outside through signal connectors 50 and 60 and filament drive signal plugs 33 and which when heated generates thermions. The thermions are absorbed by a display element 1 to which a positive potential is applied through a control grid 26 so that the display element 1 is caused to emit light.

Figure 6:
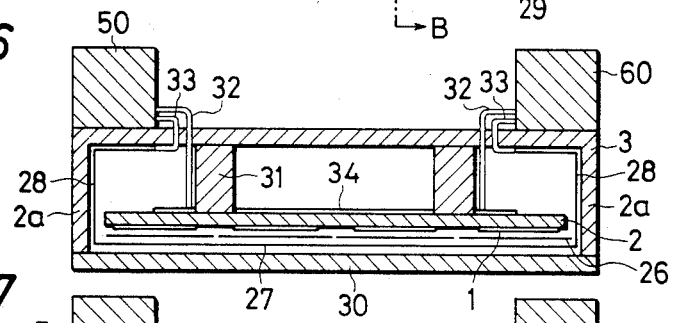
FIG. 6 shows a sectional view taken along a line A—A′ in FIG. 5.

As shown in FIGS. 6 and 7, filament braces 28 and control grid braces 29 are bent backwards, similarly to the first embodiment shown in FIGS. 3 and 4, so that the dead zone of the peripheral portion of a display unit 3 is reduced and the display elements 1 can be placed as closely to the periphery of the display unit 3 as desired. As a result, a large-size screen without conspicuous joints can be constructed.

The present invention can be applied not only to the above-described fluorescent display tube, but also to a display unit such as a cathode-ray display tube and a liquid crystal display unit which employ different principles of light emission from the fluorescent display tube.

What is claimed is:

1. A display unit comprising:

a display element board (2) having front and rear surfaces and a plurality of end portions (2*a*) disposed about the periphery of said board;

a plurality of display elements (1) mounted on said front surface of said display board inwardly of said end portions; and signal connectors disposed on at least two of said end portions, wherein said two of said end portions are disposed adjacent each other and bent back rearwardly relative to said display board.

2. The display unit of claim 1, wherein said signal connectors are disposed on each bent back end portion of said display element boards.

3. The display unit of claim 1, wherein said end portions of said display element boards are bent backwards at an angle of 90°.

4. A display screen comprising a plurality of display units mounted adjacent to one another and forming joints therebetween, wherein each display unit comprises:

a display element board (2) having front and rear surfaces and a plurality of end portions (2*a*) disposed about the periphery of said board;

a plurality of display elements (1) mounted on said front surface of said display board inwardly of said end portions; and signal connectors mounted on at least two of said end portions, wherein said two of said end portions are disposed adjacent each other and bent back rearwardly relative to said display board.

5. A fluorescent tube type display unit comprising:

a display element board (2) having a front and rear surface;

a plurality of display elements (1) mounted on said front surface of said display board;

a control grid (26) disposed over said display elements;

signal connectors (50,60) having means for supplying power to said light display elements disposed rearwardly relative to said display board;

a plurality of parallel filaments extending over said control grid;

filament braces (28) formed on each end of said filaments; and control grid braces formed on an end of said control grid, wherein said filament braces said control grid braces are bent back rearwardly relative to said display board.

6. A display screen comprising a plurality of fluorescent tube type display units mounted adjacent to one another and forming joints therebetween, wherein each display unit comprises:

a display board (2) having a front and rear surface;

a plurality of display elements (1) mounted on said front surface of said display board;

a control grid (26) disposed over said display elements;

signal connectors (50,60) having means for supplying power to said light display elements disposed rearwardly relative to said display board;

a plurality of parallel filaments extending over said control grid;

filament braces (28) formed on each end of said filaments; and control grid braces formed on an end of said control grid, wherein said filament braces and said control grid braces are bent backwards and extend behind said display board.

* * * * *